US006866173B2

(12) United States Patent
Haber

(10) Patent No.: US 6,866,173 B2
(45) Date of Patent: Mar. 15, 2005

(54) BACKPACK FOR CARRYING AN UMBRELLA AND/OR CHILD HANDS FREE

(76) Inventor: Robert Haber, 1 Sherwood Dr., Larchmont, NY (US) 10538

( * ) Notice: Subject to any disclaimer, the term of this patent is extended or adjusted under 35 U.S.C. 154(b) by 147 days.

(21) Appl. No.: 10/290,742

(22) Filed: Nov. 8, 2002

(65) Prior Publication Data

US 2004/0031827 A1 Feb. 19, 2004

Related U.S. Application Data

(60) Provisional application No. 60/403,678, filed on Aug. 15, 2002.

(51) Int. Cl.[7] ..... A61G 1/00

(52) U.S. Cl. ..... 224/160; 224/190; 224/646; 224/647; 224/915

(58) Field of Search ..... 224/160, 186, 224/190, 646, 647, 915

(56) References Cited

U.S. PATENT DOCUMENTS

| | | | | | |
|---|---|---|---|---|---|
| 988,485 | A | | 4/1911 | Mitchell | |
| 1,657,263 | A | | 1/1928 | Lauby | |
| 1,755,209 | A | | 4/1930 | Danner | |
| 2,085,984 | A | | 7/1937 | Kruithof | |
| 2,610,778 | A | | 9/1952 | Young | |
| 3,027,058 | A | * | 3/1962 | Huber | 224/155 |
| 3,120,332 | A | | 2/1964 | White | |
| 3,197,100 | A | * | 7/1965 | Thompson | 224/160 |
| 3,263,878 | A | | 8/1966 | Pratt | |
| 4,188,965 | A | | 2/1980 | Morman | |
| 4,487,346 | A | * | 12/1984 | Fischer, Jr. | 224/160 |
| 4,537,339 | A | * | 8/1985 | Pearson | 224/188 |
| 5,004,134 | A | | 4/1991 | Barry | |
| D330,455 | S | | 10/1992 | Massie | |
| 5,263,837 | A | | 11/1993 | Dompe | |
| 5,353,977 | A | | 10/1994 | Schiro, Jr. et al. | |
| 5,409,291 | A | | 4/1995 | Lamb et al. | |
| 5,513,786 | A | | 5/1996 | Drane | |
| 5,673,828 | A | * | 10/1997 | Raedel et al. | 224/160 |
| 5,699,818 | A | | 12/1997 | Carpenter | |
| 5,732,861 | A | * | 3/1998 | Jakobson | 224/160 |
| 5,819,341 | A | * | 10/1998 | Simantob et al. | 5/98.1 |
| 5,878,761 | A | | 3/1999 | Vadher | |
| 5,881,708 | A | | 3/1999 | Kliot | |
| 5,887,771 | A | | 3/1999 | Perry | |
| 5,918,612 | A | * | 7/1999 | Hughes | 135/16 |
| 5,950,894 | A | | 9/1999 | Haber | |
| 6,015,077 | A | | 1/2000 | Disher | |
| 6,024,464 | A | | 2/2000 | De Vera | |
| 6,053,385 | A | | 4/2000 | Ward et al. | |
| 6,076,539 | A | | 6/2000 | Richardson | |
| 6,308,722 | B1 | | 10/2001 | Christie | |

* cited by examiner

*Primary Examiner*—Stephen K. Cronin
(74) *Attorney, Agent, or Firm*—Jeffrey M. Kaden; Gottlieb, Rackman & Reisman, P.C.

(57) ABSTRACT

A backpack assembly includes a back portion and a front portion. The front portion includes a strap member which includes umbrella supports for holding an umbrella in an opened and closed position in front of the wearer to protect the wearer from the elements. Optionally, a child carrier may also be attached to the front portion of the backpack assembly.

26 Claims, 7 Drawing Sheets

FIG.1
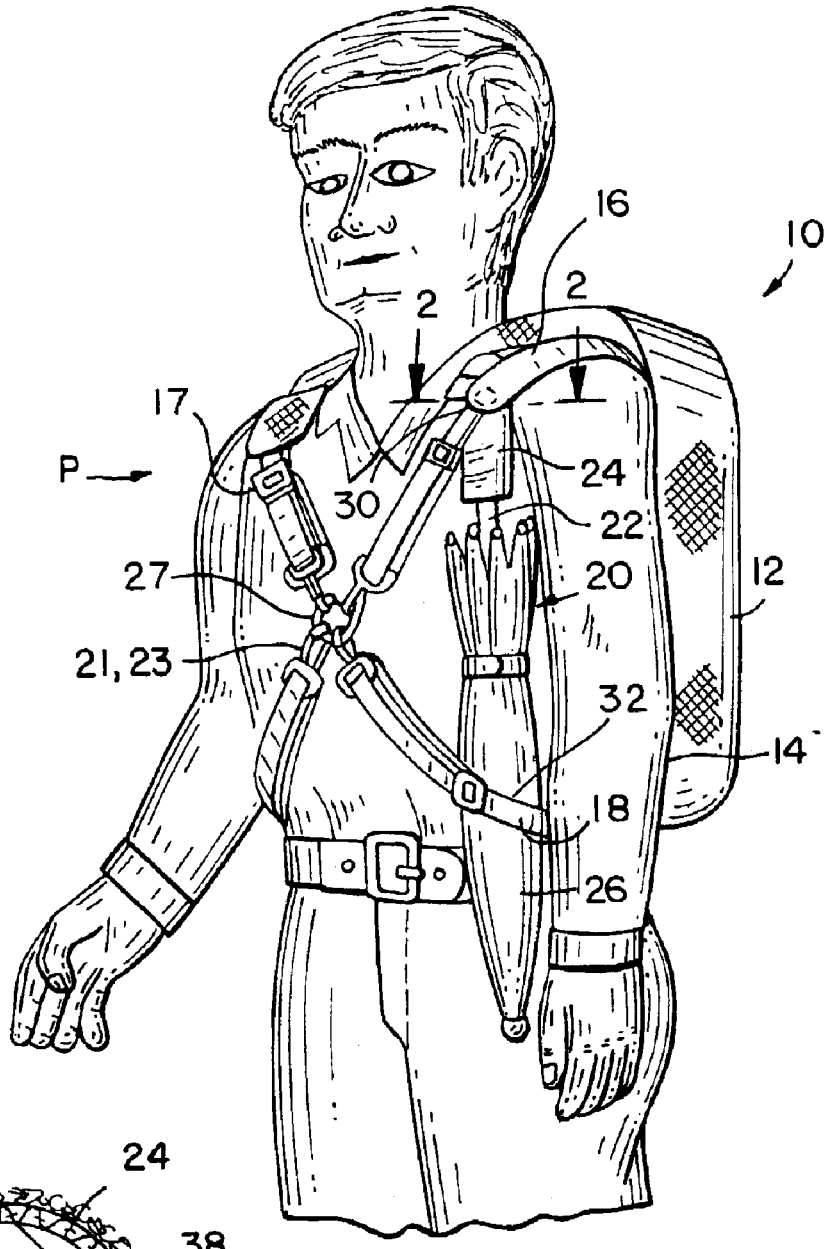
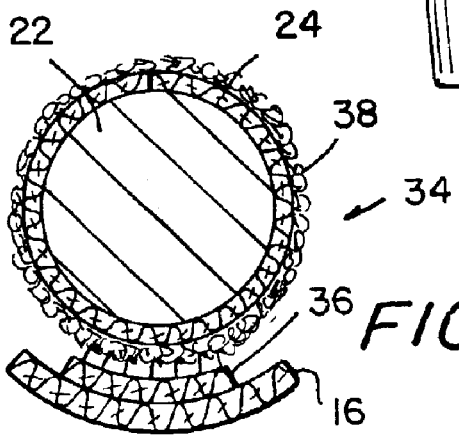
FIG. 2

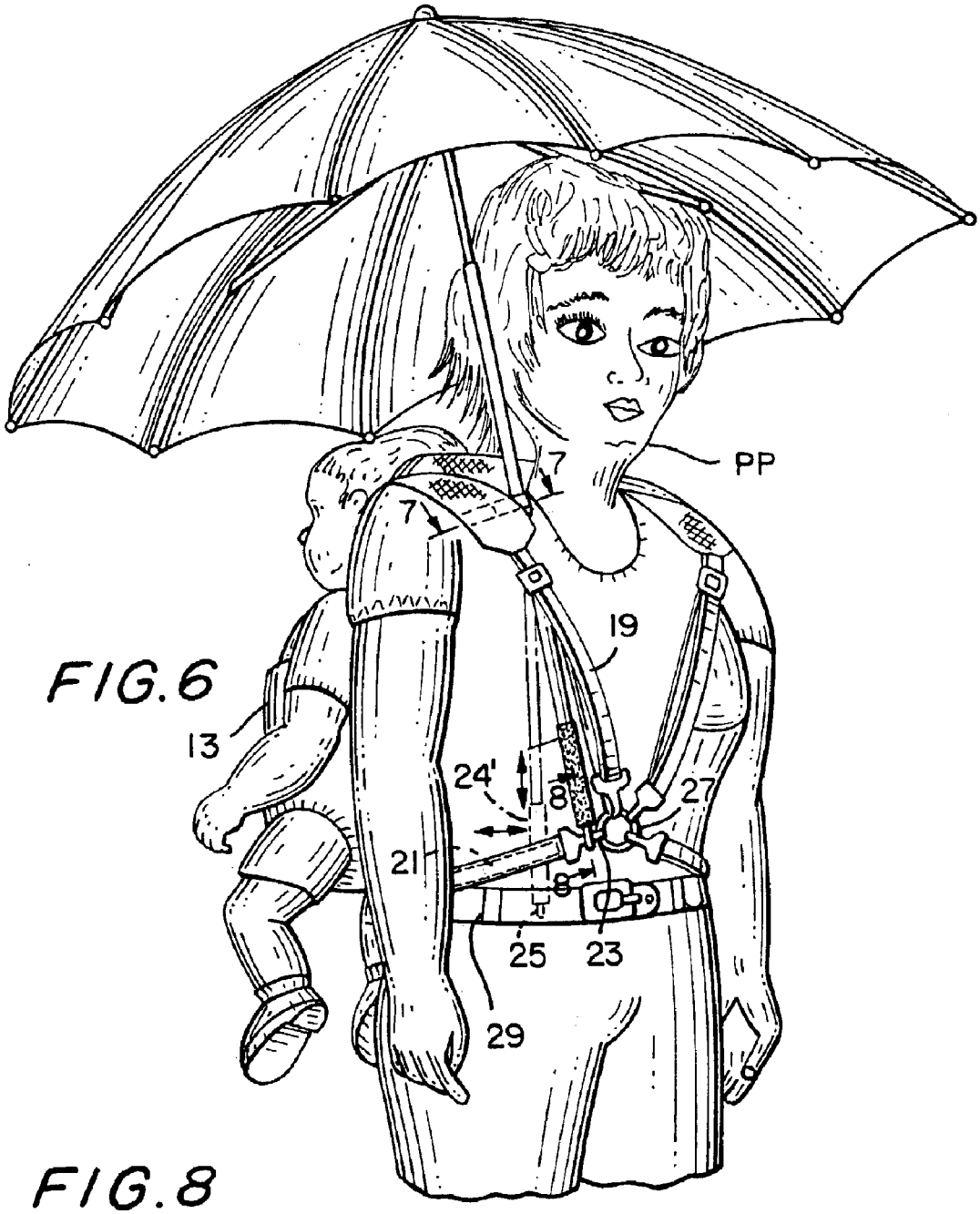
FIG. 6
FIG. 8
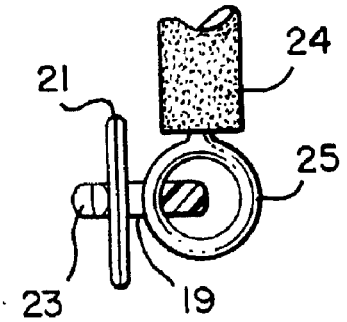
FIG. 7
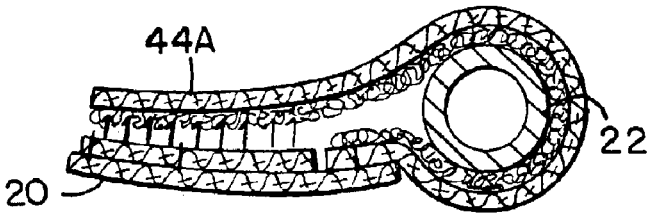

FIG. 9
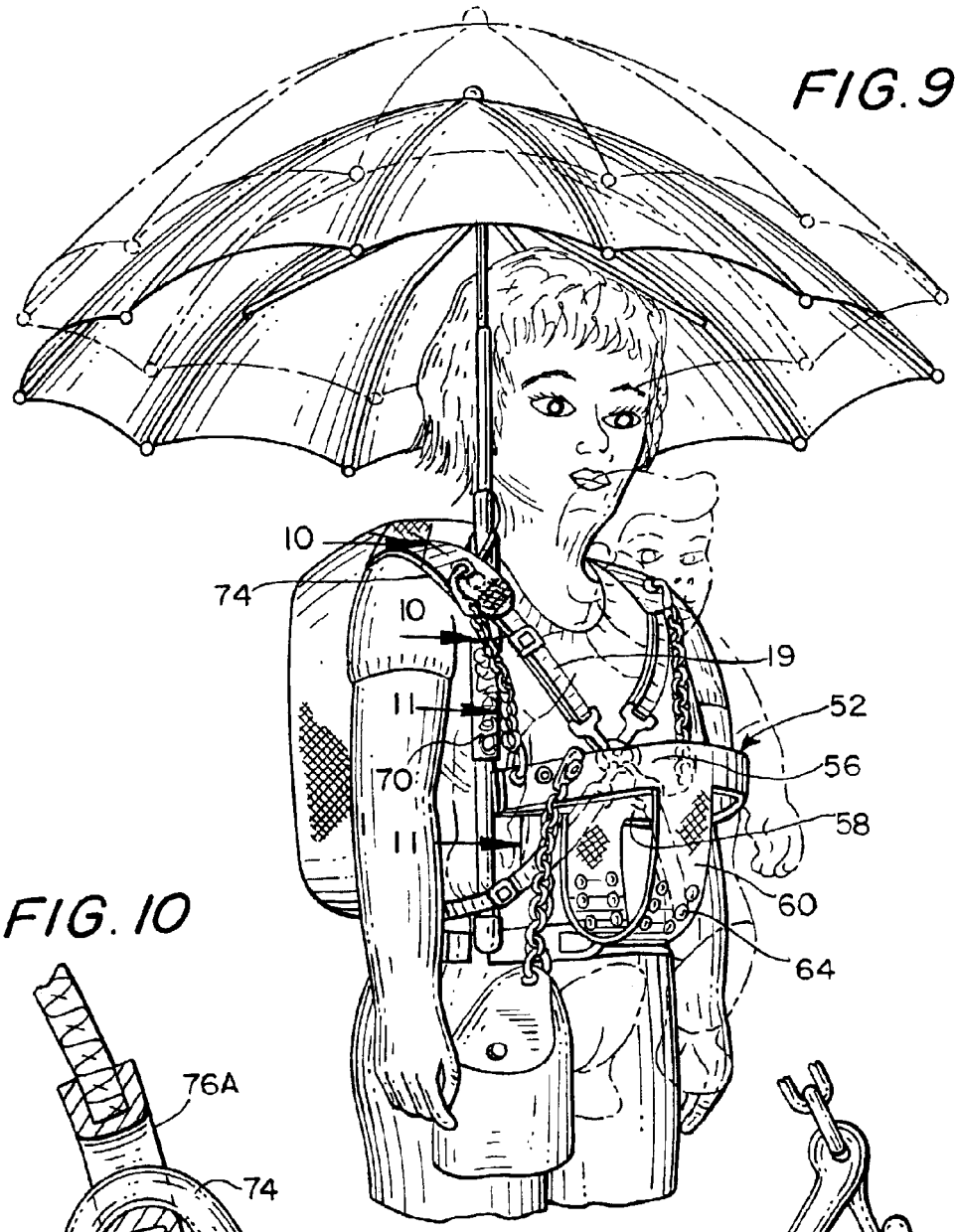
FIG. 10
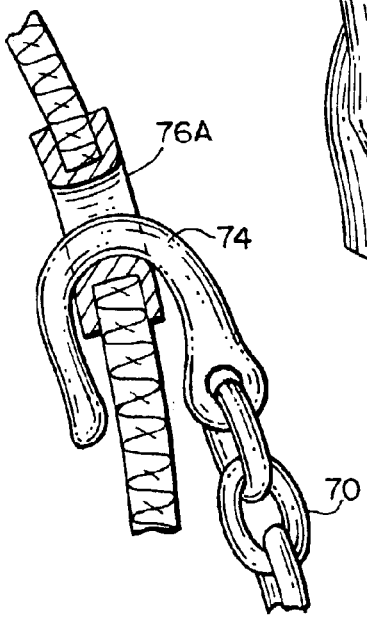
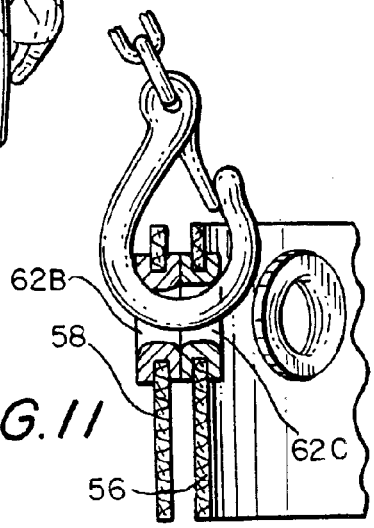
FIG. 11

BACKPACK FOR CARRYING AN UMBRELLA AND/OR CHILD HANDS FREE

RELATED APPLICATIONS

This application claims priority to provisional application Ser. No. 60/403,678 filed Aug. 15, 2002 and incorporated herein by reference.

BACKGROUND OF THE INVENTION a. Field of Invention

This invention pertains to backpack accessories and more particularly to a backpack modified to support and hold an umbrella and a child. More specifically, the backpack is adapted to hold an open umbrella thereby protecting the wearer.

b. Description of the Prior Art

Umbrellas are one of the few means that provide protection against the elements, including rain, snow or direct sunlight. One major inconvenience of umbrellas is that they require a person to hold them in a hand thereby making other tasks requiring two hands difficult. For example, when a person carrying an umbrella in one hand and a package in the other, has difficulties opening a door or a car trunk, grasping a handrail adjacent to steps, ride a bicycle, etc.

Several inventors have suggested various contraptions used to attach the shaft of the umbrella to the body of the person. For example, the following U.S. Patents show means for carrying an umbrella or a shield on a person's back: U.S. Pat. Nos. 6,308,722; 6,076,539; 6,053,385; 6,024,464; 5,887,771; 5,699,818; 5,263,837; 5,004,134; 4,188,965; 3,265,878; 3,120,332 and Des. 330,455. Of course a major disadvantage of all these arrangements is that the umbrella is difficult to use, since the person can never be sure were the umbrella is and accordingly, he may hit someone with it or knock things over. A further disadvantage is that the person can only open the umbrella by removing it, a difficult proposition at best, or he must some else to open it.

Other means of carrying and supporting an open umbrella include straps (U.S. Pat. Nos. 1,657,263; 2,610,778; 5,353,977; 5,513,786 and 5,878,761; 6,015,077) and hand-held bags (U.S. Pat. Nos. 988,485 and 1,755,269). However none of these solutions are satisfactory because they are still awkward and inconvenient, especially if a person also wears a backpack.

In addition, various harnesses are also known that can be used to hold a small child or infant, either in front or on the back. However, the person frequently also needs to carry various other items associated with child care (such as pampers, baby bottles, extra clothes, etc.) which can all be conveniently packed in a backpack, however, it is very uncomfortable for a person to wear or carry a child in a harness and a backpack simultaneously.

U.S. Pat. No. 5,950,894 by the present inventor shows a backpack assembly with straps.

SUMMARY OF THE INVENTION

In view of the above, the present inventor has developed a backpack that can be used to hold an umbrella in either an open or a closed position. In the open position, the umbrella is positioned to protect the wearer from the elements. Means are also provided to attach a soft, flexible child seat to the backpack, thereby avoiding the necessity of the carrying the umbrella and/or the child separately.

Briefly, a backpack assembly constructed in accordance with this invention includes a back portion and a front portion. The back portion may include a bag for storing various articles. The front portion includes two strap members arranged to line up vertically along a person's arms when worn. Each member has one end attached to the back portion and another end attached to toward the bottom of the back portion. Each strap member is formed of an upper and a lower strap. The free ends of the straps are interconnected to form the members. In a preferred embodiment, the free ends of all the straps are interconnected by a single central member.

At least one of the strap members is formed with an upper and a lower umbrella support member. These support members are constructed and arranged to hold an umbrella in a closed position and an open position. In the open position the umbrella protects the wearer from the elements. The umbrella is conventional and has a shaft with a handle at one end and a canopy at the other. The handle can be associated with the upper umbrella support member when the umbrella is closed and has a reverted orientation. When the umbrella is opened, it is turned so that, naturally, its canopy is on top.

The umbrella support members may include a loop and hook type fastener. In one embodiment the one member of this type fastener is attached to the strap member while the other element is attached to the umbrella. Alternatively, both elements are mounted on the strap member and form circular loops to hold the umbrella.

In an alternate configuration the umbrella of the handle is provided with a ring which may be connected to a clip on the end of one of the straps.

The backpack assembly may further include a child carrier disposed on the front of the wearer and attached to the front portion of the backpack assembly. The umbrella is then optional, but when used, it provides protection to both the wearer of the backpack and the child while leaving his hands substantially free.

In a preferred embodiment the child carrier includes a flat flexible member having an I shape defined by two parallel arms and an interconnecting member. When folded with the two parallel arms superimposed, the flexible member forms a pouch for the child. Holes are provided at the corners of the flexible member. Chains extend from these corners to the respective strap members. Several holes are provided to allow one to adjust the effective size of the pouch. Additionally the intermediate member also has holes that can be used to change the size of the pouch.

BRIEF DESCRIPTION OF THE DRAWINGS

FIG. 1 shows in elevational view a person with a closed umbrella attached to a backpack assembly in accordance with this invention;

FIG. 2 shows a sectional view of an upper umbrella support for FIG. 1;

FIG. 6 shows in elevational view of a person with an open umbrella attached to a back child carrier;

FIG. 7 shows a cross-sectional view of another upper umbrella support that can be used for the backpack or back child carrier;

FIG. 8 shows a cross-sectional view of another lower umbrella support that can be used for the backpack or the back child carrier;

FIG. 9 shows in elevational view a person with an open umbrella and a baby in a child carrier attached to a backpack in accordance with this invention;

FIG. 10 shows a sectional elevational view of a first attachment for the child carrier of FIG. 9;

FIG. 11 shows a sectional elevational view of a second attachment for the child carrier of FIG. 9;

DETAILED DESCRIPTION OF THE INVENTION

Figure 3:
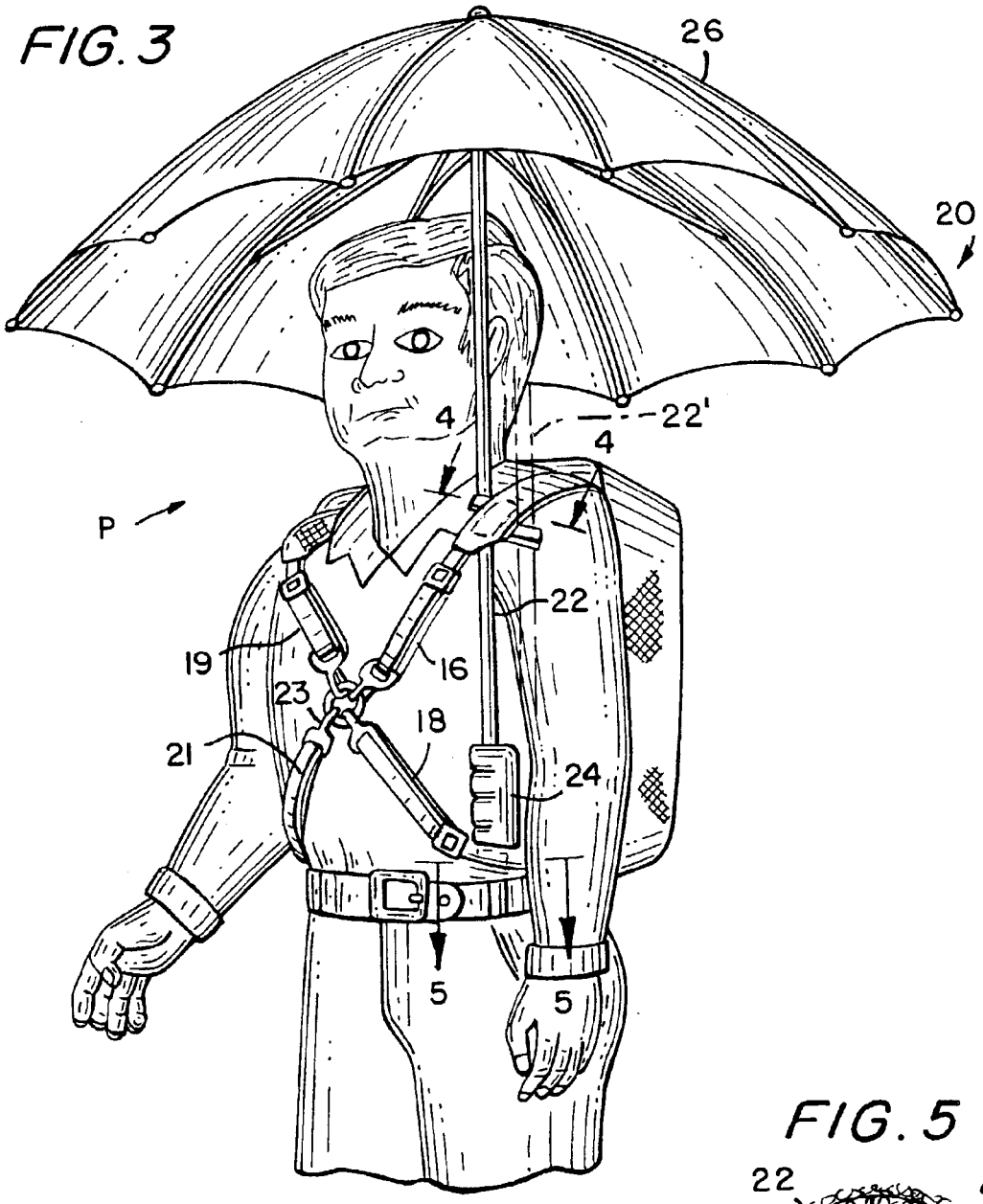
FIG. 3 shows in elevational view the person of FIG. 1 with the open umbrella.

In FIG. 1 a person P is shown wearing a backpack 10. A backpack particularly suited for the present invention is disclosed in U.S. Pat. No. 5,950,894 and incorporated herein by reference. Of course, other types of backpacks may be used as well. As shown in the Figure, backpack 10 includes a bag 12 having a front face 14 and a plurality of straps 16, 18, 19 and 21. In the embodiment shown, the four straps are coupled together by a center ring 27 disposed approximately in the middle of the person's chest. In the arrangement of FIG. 1, the coupling is accomplished using a buckle arrangement that allows the overall effective lengths to be adjusted for the comfort of the wearer. Moreover, other types of backpacks may also be used in which the straps are paired to form respective strap members, including an arrangement with two straps on the left being coupled to each other and the straps on the right being coupled to each other to form (for example, by using hooks and loops) respective strap members, or arrangements with only a single strap on each side. Other similar arrangements are discussed below. All of these types of backpacks can be modified to carry an umbrella as described below.

Figure 5:
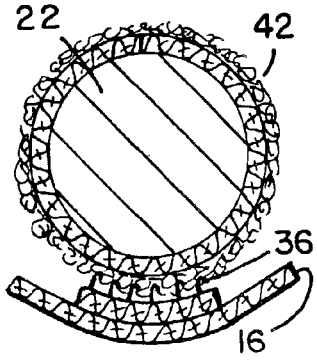
FIG. 5 shows a sectional view of a lower umbrella support.

In the depicted embodiment, the umbrella 20 is carried in the closed position on his left side by person P. The umbrella 20 is a conventional umbrella with a shaft 22, a handle 24 with loops and a collapsible canopy 26 on the other. Support means, including an upper umbrella support 30 with hooks and a lower umbrella support 32 are provided on the straps to support the umbrella 20 in the inverted position, as shown. For example, hook-and-loop type fasteners may be used to removably attach the umbrella 20 to the straps 16 and 18. FIG. 2 shows details of the upper umbrella support as including a hook member 36 attached to the strap 16 by conventional means, such as sewing, while loop member 38 is attached to the handle 24, for example, with an adhesive (not shown). The lower umbrella support may also include a hook member 40 (see FIG. 5) attached to strap 18. Other known means may be used as well for the upper umbrella support.

FIG. 3 shows person P holding the umbrella 20 in the upright position. In this position, the hook member 36 engages an extra loop member 42 disposed on the shaft 22 thereby supporting the umbrella on either side of strap 16. To insure that the umbrella remains in this position, the hook member 38 on handle 24 engages the loop member on 18.

In an alternate embodiment, person P may hold the umbrella with the shaft 22 shifted slightly to the left, as indicated at 22'. In order to maintain the umbrella 20 in this second position, a strip 44 is provided which is made of a relatively soft and flexible material. The strip 44 is attached at the ends 44A and 44B to strap 16 by sewing or other conventional means. The strip 44 is provided on its inner surface with a loop member 46. The loop member extends substantially along the length of the strip 44 as shown. The central portion of the strip 44 can be pushed inward toward hook member 36. The remaining portions of the strip 44 form two circular openings 46A, 46B for accommodating the umbrella 20 selectively with the shaft 20, 20' either disposed in opening 46A or 46B. The shaft 22 need not have a hook member as it passes under strap 16 in the positions shown in FIG. 3.

It should be noted that in two positions shown in FIGS. 1 and 3 the umbrella is disposed between the straps 16, 18 and the body of person P.

Figure 4:
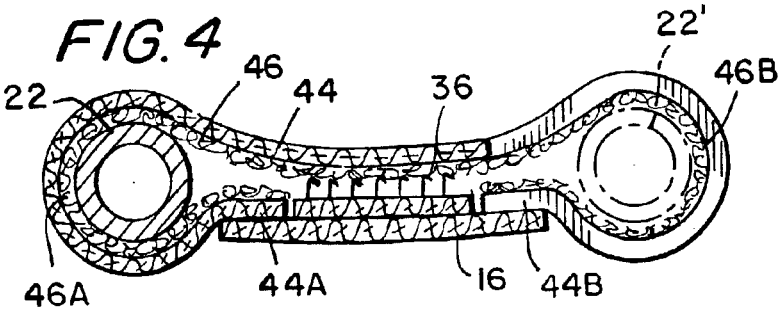
FIG. 4 shows a sectional view of an alternate upper umbrella support.

FIG. 6 shows several modifications to the invention. First, the backpack is modified by changing the bag to a child carrier 13. Second, the handle 24 is provided with a ring 26 oriented downwardly. As shown as well in FIGS. 1 and 3, the strap 21 is terminated with a clip 23 used to connect the strap 22 to the central ring 27. In the embodiment of FIG. 6 the clip 23 also engages the ring 25. In this manner, the clip 19 and ring 25 cooperate to form the lower umbrella support. The upper umbrella support may consist of a hook-and-loop fastener similar to the one of FIG. 4 but with the strap 44A being shorter to form a single circle to hold the umbrella shaft 22.

If desired, in order to adjust the position of the umbrella in the open position, the ring 25 can be decoupled from the clip 19 and the handle can be shifted to the position 24', so that the handle extends under the strap 21, and optionally, under the belt 29 (if any) to further stabilize the umbrella, as shown. The position of belt 29 can be changed by adjusting the length of the straps. This allows ladies to accommodate their demeanor, preference and/or size.

Figure 12:
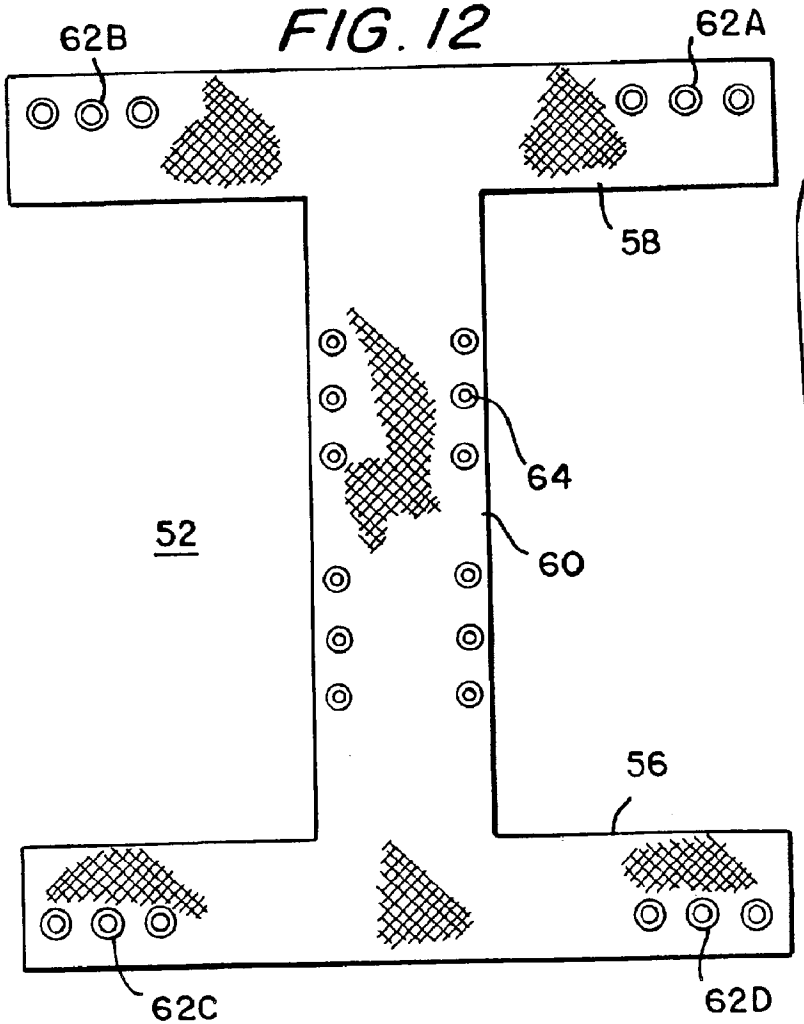
FIG. 12 shows a plan view of the child carrier of FIG. 9.

FIGS. 9–13 show a further embodiment of the invention. In this embodiment, the backpack 10 is also provided with a child carrier 50. The child carrier 50 includes a flexible body 52 and an optional back 54. As best seen in FIG. 12, the flexible body is made from a woven or non-woven material cut into an I-shape defined by two parallel arms 56, 58 and a vertical intermediate member 60. Each of the arms is provided with a plurality of holes 62 formed by eyelets. Four of these holes are identified by the numerals 62A, 62B, 62C and 62D.

Figure 13:
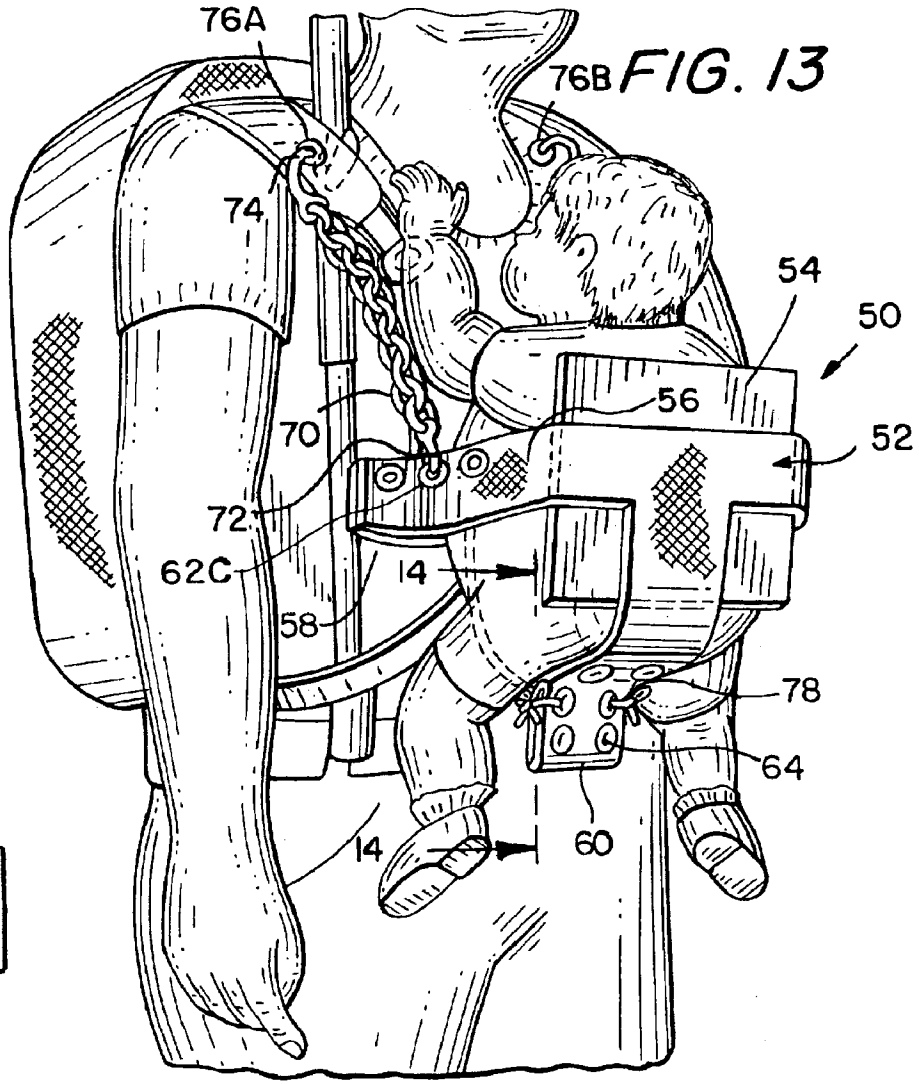
FIG. 13 shows in elevational view of a person with an umbrella and child in another child carrier attached to the backpack.

Preferably, the intermediate member 60 is also formed with holes 64. Advantageously, when the body 52 is folded so that the arms 56, 58 are superimposed, the body forms a comfortable seat for the child, as seen in FIG. 13. Importantly, the child carrier further includes two chains 70 (only one of the chains being visible in FIGS. 10 and 13). The chains have at one end a clip 72 at lower end attached to the holes 62 on arms 56, 58. More specifically, the clip 72 of one of the chains is attached to holes 62B and 62C while the clip 72 of the other chain 70 is attached to holes 62A and 62D. Preferably the clip 72 may be of the type that can be opened, as best seen in FIG. 11.

The other end of each chain 70 is provided with a hook 74. The straps 16, 20, are formed with respect holes 76A, 76B.

Each of these holes receives one of the hooks 74, as shown in FIGS. 10 and 13. Thus hooks 74 cooperate with the holes 76A, 76B on the straps 16, 20 to form respective carrier supports for supporting the child carrier on the backpack 10. As best seen in FIG. 12, several holes 62 are provided at each ends of arms 56, 58. The clips 72 can be attached or moved from one hole to another to thereby form a larger or smaller career, thereby allowing the child carrier to be customized to the size of the child.

Figure 14:
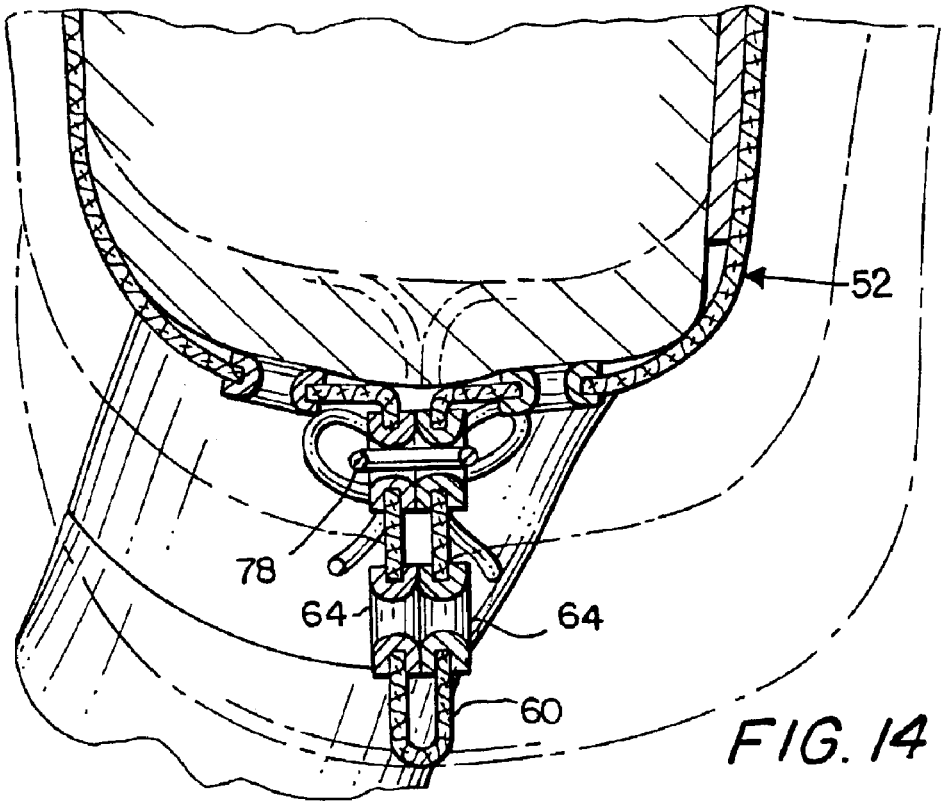
FIG. 14 shows details of how portions of the child carrier are fastened together.

The size of the child carrier may be further customized by folding the intermediate member 60 partially over itself so that the holes 64 overlap as seen in FIGS. 13 and 14. A string, a ring or other fastening means 78 may be passed through at least two of these holes on each side to keep the member 60 partially folded. If the fastening means are lower, the child carrier can hold a larger child while a small child can be accommodated if the fastening means 78 are higher.

Thus, the backpack 10 can be used not only to support an umbrella 20 (in the open and closed position) but also a separate, removable child carrier 50. The child can be carried by person PPP with the child facing forward, as in FIG. 9 or rearward, as in FIG. 13.

Figure 15:
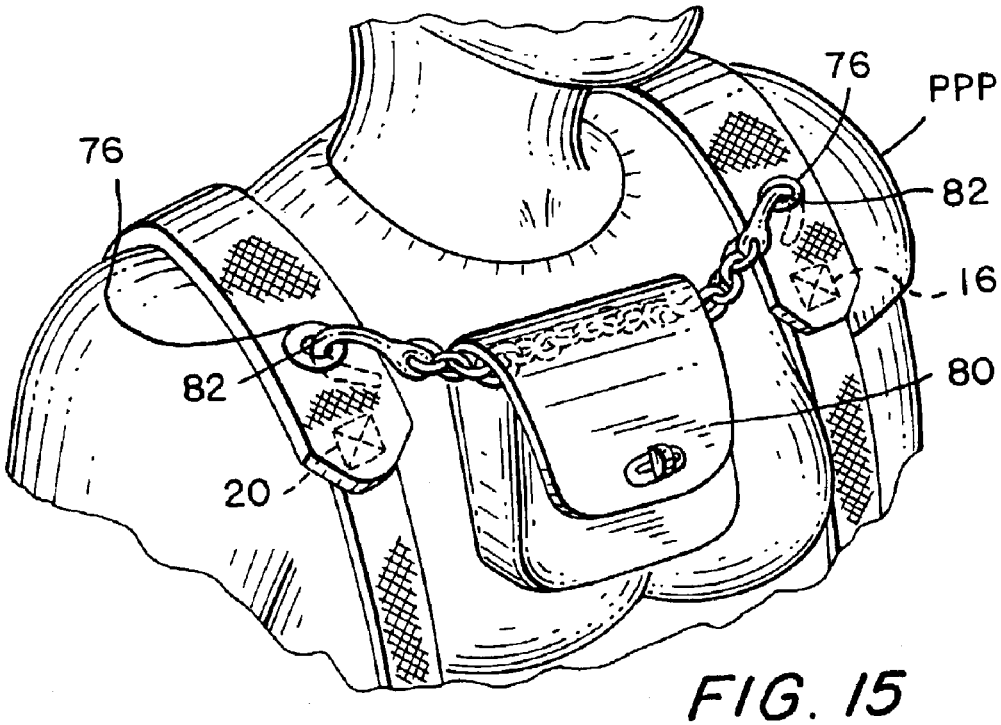
FIG. 15 shows a backpack assembly adapted to carry a handbag as well.

An advantage of providing holes on the upper straps 16, 20 is that they could be used to carry not only a child carrier, but also other items. For example, in FIG. 15 person PPP is shown carrying a backpack 10 with straps 16, 20, holes 76 and a removable pocketbook 80 having chains with hooks 82 attached to holes 76.

Figure 16:
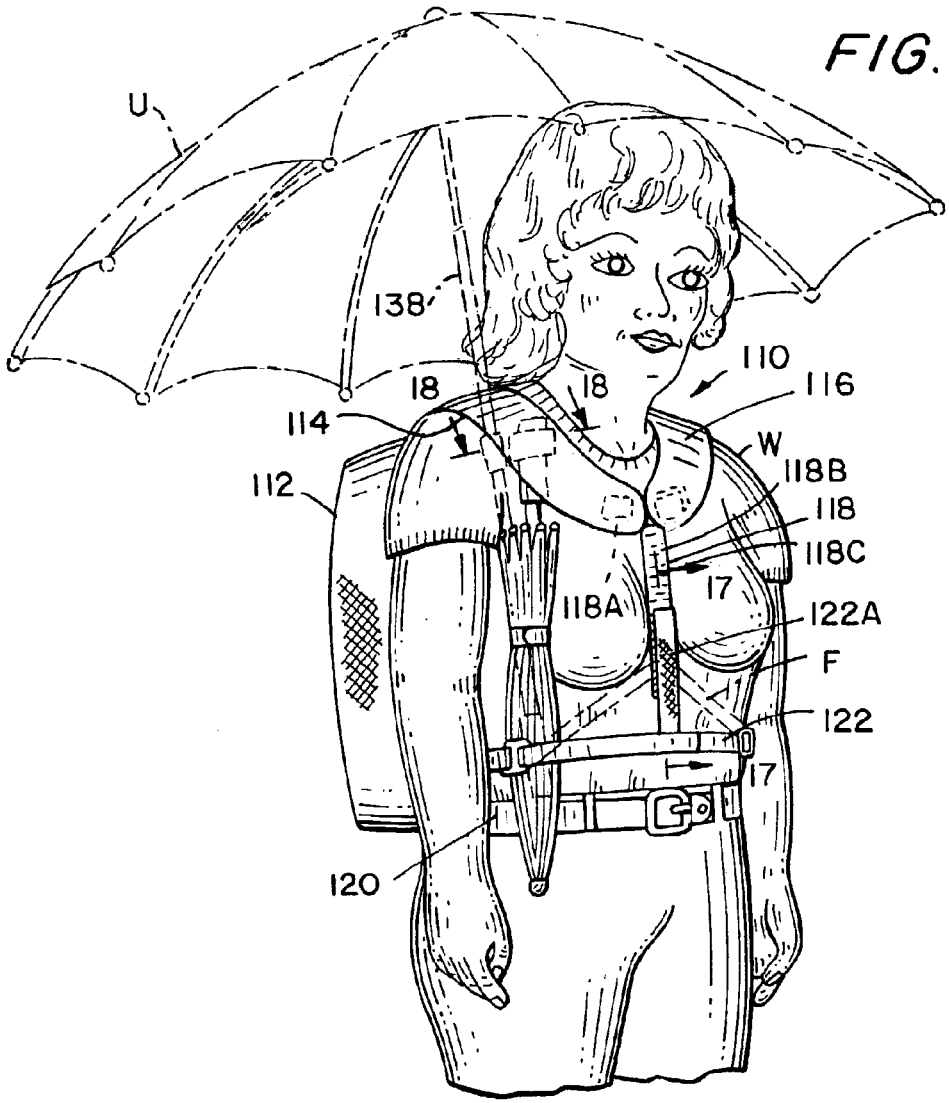
FIG. 16 shows an alternate embodiment of the backpack assembly.
Figure 17:
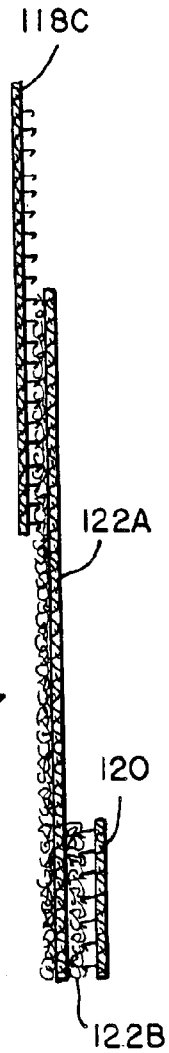
FIGS. 17 and 18 show cross-sectional views taken along lines 17—17 and 18—18 in FIG. 16.

FIGS. 16 through 17 show a somewhat preferred embodiment of a backpack 110 worn by a person W. The backpack 110 includes a bag 112, two shoulder straps 114, 116, a central strap 118 and two lower straps 120, 122. Shoulder strap 114 and lower strap 120 jointly define a strap member that may be used to hold umbrella U either in the open or closed configuration.

The five straps 114, 116, 118, 120 and 120 are joined to form an I-shaped harness with four of the straps being joined at one end to the bag 122. The five straps can be coupled to each other using various coupling means. Preferably these coupling means are constructed and arranged to allow person W to put on and remove the backpack 110 with ease. For example, the strap 118 may generally have a T-shape defined by two upper arms 118A, 118B and a vertical leg 118C. Arm 118B may be permanently joined to the end of strap 116, for example, by sewing, while arm 118A may be joined by a fastener, such as a hook-and-loop fastener to the end of strap 114.

Lower strap 122 is provided with a vertical extension 122A and a horizontal extension 122B disposed in FIG. 16 under the strap 120. The vertical extension 122A is fastened to the vertical leg 118C by any standard means, such as another hook-and-loop fastener, as seen in FIG. 17. The horizontal extension 122B (seen in profile in FIG. 17) is joined by a standard fastener means to the lower strap 120, for example, with yet another hook-and-loop fastener. In this manner, the backpack 110 is readily adjustable so that it can be worn comfortably by tall persons, short, persons, as well as skinny and fat persons. The dotted outlines in FIG. 16, for example at F show how the lower straps 120, 122 can be angled to conform to the size of person W, if necessary.

Figure 18:
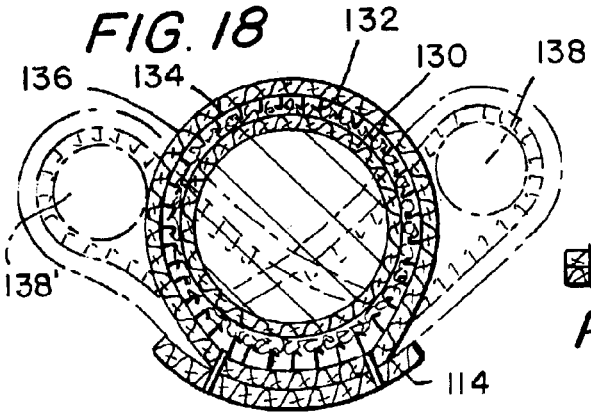

As in previous embodiments, the backpack 110 is constructed and arranged to facilitate carrying the umbrella U either in the closed or open position. For this purpose, the shoulder strap 1114 cooperates with the umbrella U to form and define an upper umbrella support means. For example, this support means may include a hook-and-loop fastener. For this purpose, the handle 130 of the umbrella U can be provided with a hook member 132 shown in FIG. 18 and the strap 114 may be provided with band 134 on its inner surface, said band 134 including a loop member 136. The umbrella U could then be supported in the closed position with the hook-and-loop fastener holding the handle 130 while the umbrella U being in the closed position and being pointed downward, so that the umbrella canopy extends under the lower strap 120. The lower strap is also adapted to form a lower umbrella support. This lower umbrella support may consist of the loop member on strap 120.

Figure 19:
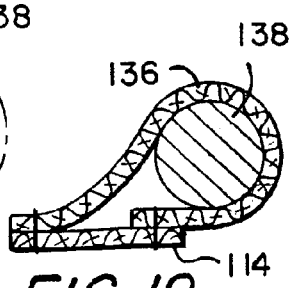
FIG. 19 shows details of the strap for holding the umbrella.

When it rains, the person W can remove the umbrella U from the backpack 110, reverse it, open and re-attach it to the backpack 110 so that the handle 130 is now engaged by the lower umbrella support. More specifically, the hook-member 132 on handle 130 can be engaged by the loop member on strap 120, while the umbrella extends upward in the open position, with its shaft passing under the shoulder strap 114. The loop member 136 is adapted to form a ring to hold the shaft 138 of the umbrella U, as seen in FIG. 19. The loop member allows the shaft to be either in the position 138 or position 138', both positions being shown in FIG. 18.

Although the invention was described with reference to several particular embodiments, it is to be understood that these embodiments are merely illustrative of the application of the principles of the invention. Accordingly, the embodiments described in particular should be considered exemplary, not limiting, with respect to the following claims.

I claim:

1. A backpack assembly comprising:

a back portion and a front portion, said front portion including a strap member having strap ends connected to the back portion;

an umbrella;

an upper and a lower umbrella support member cooperating with said strap member to support said umbrella in two positions, including a first position in which said umbrella is closed and a second position in which said umbrella is open;

wherein said strap member includes an upper and a lower strap, said straps being coupled with a ring; and wherein said lower support member includes a connecting member coupled to said ring.

2. The backpack assembly of claim 1 wherein said umbrella has a shaft with a handle on one end and a canopy on the other end, and wherein said handle is associated with said upper umbrella support member in said closed position and with said bottom umbrella support member in said open position.

3. The backpack of claim 1, wherein handle includes a ring and wherein in said handle includes a member selectively coupled to said ring.

4. The backpack of claim 1 wherein said back portion comprises a bag.

5. The backpack of claim 1 wherein said back portion comprises a child carrier.

6. The backpack of claim 1 further comprising a child carrier attached to said strap member.

7. A backpack assembly comprising:

a back portion;

a front portion including an upper and a lower strap, each strap having one end connected to said back portion and another end, and means for fastening said straps together; and an upper and lower umbrella support member, each umbrella support member being secured to one of the respective upper and lower members, said umbrella support members being adapted to support an umbrella in front of the wearer.

8. The backpack assembly of claim 7 wherein said upper and lower support members include hook-and-loop fasteners.

9. The backpack assembly of claim 7 wherein said umbrella support members are adapted to support the umbrella in an open and a closed position.

10. The backpack assembly of claim 7 further comprising a child carrier attached to said front portion.

11. The backpack assembly of claim 10 wherein said child carrier includes a body and fastener means attaching said body to said front portion.

12. The backpack assembly of claim 10 wherein said body has an I-shape defined by two parallel arms and an intermediate member extending between the arms.

13. The backpack assembly of claim 12 wherein said body is formed with holes in said arms for receiving said fastener means.

14. The backpack assembly of claim 7 wherein said front portion includes an upper right and an upper left strap, said upper straps being curved and shaped to extend toward each other.

15. The backpack assembly of claim 14 wherein said upper straps have free ends connected to each other.

16. The backpack of claim 14 further comprising a vertical strap extending from said upper straps to said lower strap.

17. A child carrier adapted to be carried on straps secured to a wearer, said child carrier comprising:

an I-shaped body formed of two parallel arms and an intermediate member extending between the arms; and fastening means having first ends adapted to hold the respective ends of each said arms when said arms are folded so that they are superimposed to form a pouch and second ends adapted to engage said straps.

18. The child carrier of claim 17 wherein each end is provided with a plurality of holes, said holes defining the size of said poach.

19. The child carrier of claim 18 wherein said intermediate member is formed a second set of holes used to define a dimension of said poach.

20. The child carrier of claim 17 wherein said fastening means are chains.

21. A backpack assembly comprising:

a back portion and a front portion, said front portion includes a strap member having strap ends connected to the back portion;

an umbrella; and an upper and lower umbrella support member cooperating with said strap member to support said umbrella in two positions, including a first position in which said umbrella is closed and a second position in which said umbrella is open; and wherein said back portion comprises a bag.

22. The assembly of claim 21, wherein said umbrella support members comprise hook-and-loop fasteners.

23. The assembly of claim 21, wherein said umbrella has a shaft with a handle on one end and a canopy on the other end, and wherein said handle is associated with said upper umbrella support member in said closed position and with said bottom umbrella support member in said open position.

24. A backpack assembly comprising:

a back portion and a front portion, said front portion includes a strap member having strap ends connected to the back portion;

an umbrella; and an upper and tower umbrella support member cooperating with said strap member to support said umbrella in two positions, including a first position in which said umbrella is closed and a second position in which said umbrella is open; and wherein said back portion comprises a child carrier.

25. The assembly of claim 24, wherein said umbrella support members comprise hook-and-loop fasteners.

26. The assembly of claim 24, wherein said umbrella has a shaft with a handle on one end and a canopy on the other end, and wherein said handle is associated with said upper umbrella support member in said closed position and with said bottom umbrella support member in said open position.

* * * * *